United States Patent [19]

Clausen

[11] 4,268,099

[45] May 19, 1981

[54] SECURE EQUIPMENT RACK

[76] Inventor: Jack L. Clausen, 7404 Monte Vista Ave., La Jolla, Calif. 92037

[21] Appl. No.: 56,045

[22] Filed: Jul. 9, 1979

[51] Int. Cl.[3] ..... E05B 73/00

[52] U.S. Cl. ..... 312/280; 108/56.3; 211/4; 248/551; 312/215

[58] Field of Search ..... 312/215, 223, 280; 211/4; 248/551, 552, 553; 109/38, 39, 31; 70/18, 58, 59; 108/51

[56] References Cited

U.S. PATENT DOCUMENTS

| | | | |
|---|---|---|---|
| 1,970,178 | 8/1934 | Michlum | 109/51 |
| 3,490,598 | 1/1970 | Federman | 211/4 |
| 3,690,130 | 9/1972 | Eutzler | 211/4 |
| 4,074,637 | 2/1978 | Lorenzen, Jr. | 211/4 |
| 4,123,922 | 11/1978 | Kuenstler | 211/4 |

*Primary Examiner*—Casmir A. Nunberg

*Attorney, Agent, or Firm*—Brown & Martin

[57] ABSTRACT

A rack for securing equipment against theft comprises a plurality of generally rectangular shaped shelves having an upper planar support surface and a pair of diagonally extending passage ways extending to diagonally opposite corners and including openings between the passage ways and the surface of the shelf. The shelves are supported by vertical tubular support structures that communicate with the passage ways at the corners of the respective shelves. The rack includes an enclosed compartment that is secured against theft by means of a locked door. Security cables or chains extend from an anchored position inside the security closure and through the tubular members to positions on the shelves for securing to the underside of the appliances and other equipment, such that the cables are not accessible for cutting.

12 Claims, 6 Drawing Figures

SECURE EQUIPMENT RACK

BACKGROUND OF THE INVENTION

The present invention relates to security devices and pertains particularly to a security rack or shelving for supporting and securing appliances and other equipment in position on open racks against theft.

The theft of appliances, office and laboratory equipment has become a trememdous problem in recent years. Recent developments in scientific and electronic equipment has rendered such equipment fairly compact and easily transportable yet very expensive and valuable. For this reason the theft of such equipment from open display racks in stores and from racks and support structures during burglaries is quite common.

Many approaches to the securing of such equipment against theft have been proposed in the past. One such approach has been to secure the equipment to display racks by bolting or by means of chains and cables. Such an approach is frequently successful in preventing theft during daylight hours from stores and the like but is ineffective for securing such equipment against theft during burglaries. Locked chains and cables are easily cut by bolt cutters and the like permitting easy removal of the equipment.

The following U.S. Patents are exemplary of the prior art approach to this securing of various appliances, equipment and the like against theft.

U.S. Pat. No. 2,868,605 issued Jan. 13, 1959 to O'Connor discloses a locker arrangement having chains 200 which extend through the sleeves of garments and are anchored at one end to the garment hanger and the other and being securable in position by means of locker doors or slots in locker doors.

U.S. Pat. No. 3,724,798 issued Apr. 3, 1973 to Locasey discloses a stand for supporting an appliance wherein a television set or the like is bolted to a table which is itself bolted to a floor plate.

U.S. Pat. No. 3,744,282 issued July 10, 1973 to Hemphill discloses an office equipment locking device including a bolt for securing a base plate of a typewriter to a table with a locking nut.

U.S. Pat. No. 3,990,276 issued Nov. 9, 1976 to Shontz discloses a theft protection device for appliances and portable office equipment, wherein a typewriter is illustrated as secured to a table or desk by means of a flexible cable or lock assembly.

U.S. Pat. No. 4,055,973 issued Nov. 1, 1977 to Best discloses an equipment lock wherein office or laboratory equipment is secured to a table or the like by means of cables secured at one end to the equipment and locked at the other end beneath the table.

It is therefore desirable that some means be available to secure such equipment against theft.

SUMMARY AND OBJECT OF THE INVENTION

It is therefore the primary object of the present invention to overcome the above problems of the prior art.

Another object of the present invention is to provide a secure rack or the like having means for securing high priced equipment against theft.

In accordance with the primary aspect of the present invention a supporting rack includes a supporting structure with tubular passage ways extending from a mounting position on the support structure to a secure chamber, for connecting secure cables and chains and the like at one end to equipment mounted on the support surface and at the other end to anchoring devices within the secure chamber to secure equipment against access to the cable by means of bolt cutters and the like.

The above and other objects and advantages of the present invention will become apparent from the following description when read in conjunction with the drawings wherein.

DETAILED DESCRIPTION OF PREFERRED EMBODIMENT

Figure 1:
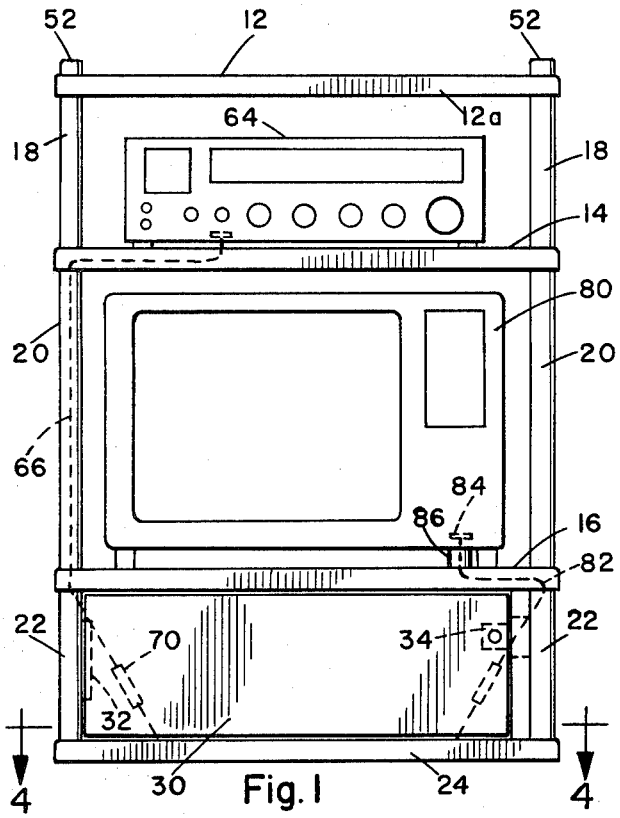
FIG. 1 is a front elevational view of a typical rack assembly with equipment secured in place.

Turning now to the drawings, particularly FIG. 1, there is illustrated a security rack in accordance with the preferred embodiment of the present invention.

Looking alternately now between FIGS. 1–4 the rack comprises generally a plurality of shelves 12, 14, and 16 all supported by a plurality of vertical columns such as made up of a plurality of sections. For example, four identical tubular sections 18 extend between and support shelf 12 above shelf 14, with a plurality of identical sections 20 extending between shelves 14 and 16 for supporting shelf 14 and 16. Shelf 16 is supported by means of a plurality of sections 22 above a base member 24.

Figure 4:
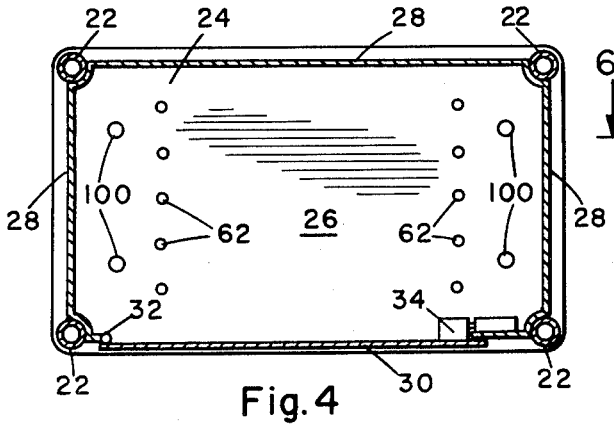
FIG. 4 is a sectional view taken on line 4—4 of FIG. 1.

A secure compartment, as best seen in FIG. 4, consists of a generally box like structure 26 having a top and three fixed sides 28 secured between base member 24 and shelf 16. A door 30 is hinged at 32 to the side of the box or cabinet and has a lock 34 for locking the door 30 in a secured or closed position.

The construction of the present invention is such that portable knock down modular shelving units are provided, which may be utilized to form any suitable number and spacing of shelves and the like. These elements fit together and are secured together in a manner to prevent removal of the support rack or equipment from the rack.

A typical construction for a shelf 12, for example, would include an upper flat planar surface for supporting equipment and the like and having a downward extending flange **12*a* extending around the periphery thereof. This skirt or flange reinforces and supports the shelf structure. Additionally a pair of diagonally extending tubular members 36 and 38 extend to opposite corners of the generally rectangular shelf member 12. These provide additional reinforcement of the support structure as well as providing communication with the vertical support columns as will be described. At each corner of the shelf 12 is a generally circular opening or bore only one of which is shown at 40. These openings receive extension portions 18*a* of the tubular sections 18. Each of the tubular sections includes an opening or cut-out slot 18*b* communicating with the interior or passage of the tubular members 36 and 38. This permits the extension of a cable from the passageways 36, 38** into the tubular center of each of the support columns or sections 18.

Each of the shelves include a plurality of holes or bores 48 communicating from the upper surface into the respective tubular passageways 36 & 38. These holes or bores each define a mounting position on the support or shelf surface, permitting the extension of a securing cable or the like through the hole and securing it to a position on a piece of equipment or the like. This is one approach to the construction of the rack in accordance with the invention. Other approaches are possible so long as a securing enclosure of some form is provided and an enclosed passageway providing a shield for a steel cable or the like extends from the secure enclosure to the point of mounting or mounting position of the piece of equipment. The passageway of course can have any suitable cross-sectional configuration such as circular, square, or any other shape.

Figure 3:
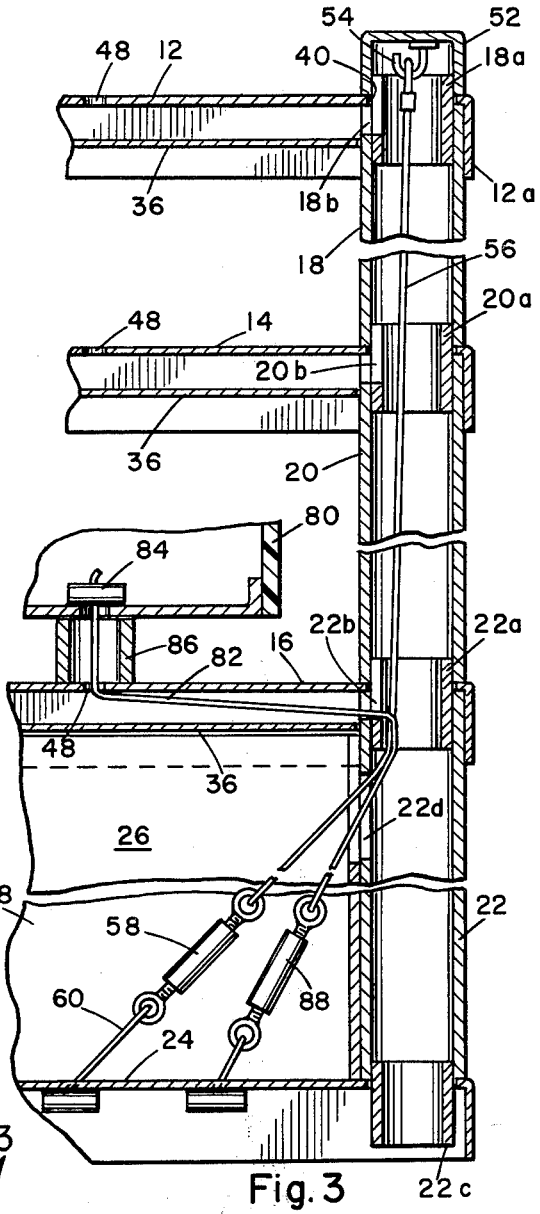
FIG. 3 is an enlarged sectional view taken on line 3—3 of FIG. 2.
Figure 2:
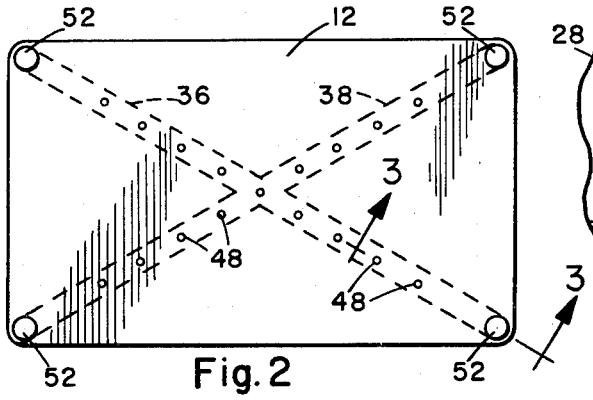
FIG. 2 is a top plan view of the rack assembly of FIG. 1.

As shown in FIG. 3 the illustrated embodiment includes extensions on the respective tubular support members 18, 20, 22 to extend into the tubular bore of the adjacent section or column. In addition the upper end of the column above the upper shelf is provided with an end cap 52, which includes a hook 54 on the inside thereof for connecting to a cable 56 for holding the cap in position on the top of the support post or column. The cable 56 extends through the passageway defined by the column down to the secure enclosure defined by the compartment 26 and extends through an opening **22*d* in the column 22 into the inside of the compartment 26, where the cable is secured by means of a turn-buckle 58 and a suitable anchoring device 60 through an opening or bore 62 in the base plate 24. Access to the turn-buckle 58 for removing or releasing the cable to permit removing cap 52 is only through the lockable door 30** of the enclosure.

Other appliances or equipment may be mounted or supported on to the various shelves of the support rack and secured in position by means of similar cables extending from each appliance or piece of equipment through the respective passage ways to the secure enclosure at 26. As illustrated for example in FIG. 1, a piece of equipment illustrated for example as a stereo receiver designated generally by the numeral 64, is mounted on the shelf 14 and is secured in position by means of a cable shown in broken line at 66, secured at an upper end 68 directly to the chassis of the receiver 64 and extending through one of the bores 48 or 50 into the respective channel 36 or 38 to the column section 20, downward to a turn-buckle or other anchoring device at 70 inside the secure enclosure 26.

An appliance or piece of equipment illustrated as a television set 80 is mounted on the shelf 16 and is secured in position by means of a cable 82 which extends into and is secured to the chassis of the television by a suitable clamp or the like 84 on the upper end of the cable, which extends through a sleeve 86 to an opening 48 into channel 36 of the shelf 16, as in FIG. 3. The cable then continues through opening **22*b* into the tubular member 22 and downward, exiting from the tubular member 22 into the secure enclosure 26 and being secured in place by an anchoring device such as a turn-buckle or the like 88**. With this arrangement the cable can be strung through the passageway after securing to the piece of equipment and then secured or anchored in place in the enclosure by means of a turn-buckle, which then can be utilized to take up the slack or place tension in the cable. With this arrangement the appliance cannot be moved or lifted from its shelf to provide access to the cable for cutting with bolt cutter, hack saws and the like.

An additional feature of the security concept is the provision of the tubular sleeve 86 which provides a shielding passageway between the opening 48 in the surface of the shelf and the underside of the chassis of the unit 80. Frequently it is necessary to secure the unit or equipment to the shelf at a position which would normally leave the cable 82 exposed. To eliminate the exposure of the cable the shielding tube 86 thus provides a shielded passageway extending completely from the appliance or equipment to the secure enclosure 26. With this arrangement the equipment can be quickly and easily secured in place and removed by a person having a key to the lock 34 of the secure enclosure. A single lock and a single key can be provided to provide access to a number of different appliances resting on the shelf.

Figure 5:
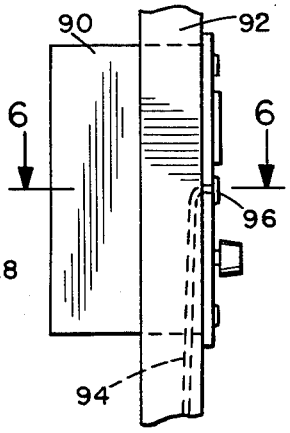
FIG. 5 is a side elevation showing a rack mounted component secured to a corner post.
Figure 6:
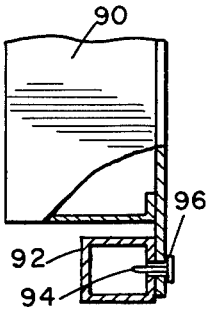
FIG. 6 is a sectional view taken on line 6—6 of FIG. 5.

Additional and alternate embodiments of the invention are possible, such as illustrated in FIGS. 5 and 6, wherein an appliance or piece of equipment 90 is secured at a mounting position on a support rack member 92 consisting of a tubular rod or frame member extending between suitable support members not shown. The appliance 90 is secured in place in a similar fashion to that previously described by means of a flexible steel cable 94, which is secured at an upper end 96 to the appliance 90, extending through an opening 98 into the tubular member 92. The other end of the cable, not shown, extends through the passageway defined by the tubular member 92 to a secured enclosure such as illustrated in FIG. 4. Again with this arrangement the equipment 90 is quickly and easily secured in place by means of a flexible cable or the like which extends through the passageway and is shielded by the surrounding structure between the appliance and a secured enclosure. Again easy access to the removal of the equipment is provided by means of a single lock and key for the single secure enclosure.

Additional security may be achieved by bolting the rack to the floor or wall of a building structure. This can be accomplished by means of holes 100 in the base plate 24 of the enclosure 26. Access to the bolts would be provided only through the secure compartment.

While I have illustrated and described my invention by means of specific embodiments it is to be understood that numerous changes and modification may be made in the invention without departing from the spirit and scope of the invention as defined in the appended claims.

I claim:

1. A security mounting system for securing appliances against theft comprising in combination:

a supporting rack having at least one mounting position for mounting an appliance, said rack including an accessible secure enclosure having an opening and a closure member providing selective access through said opening to the interior of said enclosure, and an enclosed passageway extending from said secure enclosure to said mounting position, and an elongated high strength flexible member extending through said passageway and detachably securable at one end to said rack in an accessible position within said secure enclosure and extending from said passageway at said mounting position for detachably securing the other end to an appliance so that said other end is non-accessible when said one end is secured in position in said enclosure.

2. The security mounting system of claim 1, wherein said rack includes a shelf and a plurality of mounting positions on said shelf defined by openings communicating with said passageway.

3. The security mounting system of claim 1, wherein said rack comprises a plurality of shelves and a plurality of generally vertical tubular members supporting said shelves and defining at least a portion of said passageway.

4. The security mounting system of claim 3 wherein;

said shelves include passageways communicating with the interior of each of said tubular members and with multiple positions to the support surface of said shelf.

5. The security system of claim 4 wherein said shelves are generally rectangular in configuration and includes a diagonal tubular member extending between diagonally opposite corners and communicating with said tubular members.

6. The security mounting system of claim 1 wherein said rack comprises a plurality of shelves;

a plurality of generally vertical tubular members supporting said shelves and defining at least a portion of said passageway;

said vertical tubular members comprise a plurality of telescoping members and a cap on the end of each vertical tubular member; and an elongated high strength flexible member secured at one end to said cap and at the other end to said rack in said secure enclosure.

7. The security mounting system of claim 1 wherein said rack is secured to a building structure by means of bolts accessible only through the secure enclosure.

8. A security mounting system for securing appliances against theft comprising in combination:

a supporting rack comprising a plurality of generally rectangular shelves, said shelves include a diagonal tubular member extending between diagonally opposite corners and defining passageways communicating with multiple positions on the support surface of said shelves for mounting an appliance, a plurality of generally vertical tubular members supporting said shelves and defining at least a portion of an enclosed passageway, said rack including a secure enclosure and an enclosed passageway extending from said secure enclosure to said mounting positions, said secure enclosure comprising a generally box-like enclosure having an opening communicating with the interior thereof;

a closure member pivotly mounted on said enclosure for closing and opening, and lock means for locking said closure member in the closed position; and an elongated high strength flexible member extending through said passageway and secured at one end to said rack in said secure enclosure and extending from said passageway at said mounting position for securing the other end of an appliance.

9. The security system of claim 8 including means defining an opening communicating from the interior of said box with the interior of each of said tubular members.

10. The security system of claim 9 wherein said vertical tubular member each comprises a plurality of telescoping members and a cap on the upper end of the top member;

a cable secured at one end to said cap and at the other end to said rack in said secure enclosure.

11. The security system of claim 10 including a turnbuckle securing the ends of said cable in said secure enclosure.

12. The security system of claim 11 including a tubular shield for shielding said cable between said openings in said shelf and an appliance on said shelf.

* * * * *